United States Patent [19]

Purcaru

[11] Patent Number: 4,695,228

[45] Date of Patent: Sep. 22, 1987

[54] TURBO-MACHINE BLADE

[75] Inventor: Bebe-Titu Purcaru, Mülheim, Fed. Rep. of Germany

[73] Assignee: Kraftwerk Union Aktiengesellschaft, Mülheim, Fed. Rep. of Germany

[21] Appl. No.: 286,894

[22] Filed: Jul. 27, 1981

[30] Foreign Application Priority Data

Jul. 31, 1980 [DE] Fed. Rep. of Germany ..... 3029082

[51] Int. Cl.[4] ..... F01D 5/14

[52] U.S. Cl. ..... 416/223 A; 416/243; 416/DIG. 2

[58] Field of Search ..... 416/223 R, 223 A, 243, 416/DIG. 2

[56] References Cited

U.S. PATENT DOCUMENTS 3,077,173 2/1963 Lang ..... 416/243 X
3,140,042 7/1964 Fujii ..... 416/243

FOREIGN PATENT DOCUMENTS 0123301 9/1980 Japan ..... 416/223 A
266475 7/1976 U.S.S.R. ..... 416/223 R

*Primary Examiner*—Harvey C. Hornsby
*Assistant Examiner*—Frankie L. Stinson
*Attorney, Agent, or Firm*—Herbert L. Lerner; Laurence A. Greenberg

[57] ABSTRACT

Turbo-machine blade with a profile contour having a convex leading edge region, a convex suction side region, a convex trailing edge region and a concavely curved pressure side region, including profile segments being blended into each other forming the profile contour and following each other in a continuous curve, the profile segments including:

(a) a first ellipse segment and a second ellipse segment adjacent to the first ellipse segment in the leading edge region, (b) a first circle segment adjacent to the second ellipse segment and a second order parabola segment adjacent to the first circle segment in the suction side region, (c) a second circle segment adjacent to the parabola segment in the trailing edge region, and (d) a third circle segment adjacent to the second circle segment and the first ellipse segment in the pressure side region.

6 Claims, 6 Drawing Figures

TURBO-MACHINE BLADE

The invention relates to a turbine or rotating machine blade with a profile contour which is convex in the region of the leading edge, the suction side and the trailing edge, and concavely curved in the region of the pressure side.

The blade profiles of turbo-machine blades of this type are conventionally constructed using empirical methods, whereby the profile contour is created from individual support points or base points which do not obey mathematical laws, or the profile contour is put together from circular arcs and straight lines. However, when using a method of construction of this kind, discontinuities in the curvature of the profile contour result, and it is extremely difficult and problematical to achieve an optimum profile contour with respect to flow-dynamic or fluidic principles, while at the same time fulfilling necessary strength requirements.

It is accordingly an object of the invention to provide a turbo-machine blade which overcomes the hereinafore-mentioned disadvantages of the heretofore-known devices of this general type, and which has a profile contour that can be simultaneously adapted with small construction effort to the flow dynamic as well as to the mechanical requirements.

With the foregoing and other objects in view, there is provided, in accordance with the invention, a turbo-machine blade with a profile contour having at least four sections each of which is a portion of a curve of second or higher order, namely a convex leading edge region, a convex suction side region, a convex trailing region and a concavely curved pressure side region, comprising profile segments being blended into each other forming the profile contour and following each other in a continuous curve, said profile segments including:

(a) a first ellipse segment and a second ellipse segment adjacent to or bordering or following the first ellipse segment in the leading edge region, (b) a first circle segment adjacent to the second ellipse segment and a parabola segment of a second order parabola adjacent to the first circle segment in the suction side region, (c) a second circle segment adjacent to the parabola segment in the trailing edge region, and (d) a third circle segment adjacent to the second circle segment and the first ellipse segment in the pressure side region.

The turbo-machine blade according to the invention has a profile contour which includes segments of mathematically exactly defined second order curves that are combined in such a manner that the whole contour has a continuous curvature. By the use of this provision, it is also possible to mathematically exactly calculate the position of the center of gravity, the inclination of the main axes, the inertia moments, the bending resistance moments, the position of the thrust or shear center or point, the drill-resistance and the torsion resistance moment. The exact knowledge of these parameters permits a reliable and exact calculation of the strength and vibratory behavior. By making a suitable choice of the parameters of the second order curves which form the profile contour, a profile contour which satisfies the flow-dynamic requirements as well as the mechanical requirements can be constructed. After completing the calculation with respect to the flow dynamics, whereby one determines the pressure distribution, angle of exit or down-wash, profile losses and the like, a flow dynamic optimization can be made by slightly altering the parameters, without deteriorating the required strength properties in the process. This possibility of optimizing the flow dynamics without reducing the strength is not possible with the known profile contours. Further advantages of the turbo machine blades made according to the invention are experienced during the manufacture. Conventional machining methods can be used, whereby the accuracy of the manufacture is considerably increased due to the mathematically defined profile contour, because each point of the profile contour can be exactly defined, and a practically unlimited number of reference points can be chosen.

In accordance with another feature of the invention, the first ellipse segment and the second ellipse segment are formed of ellipses having a common greater or major half axis and a common vertex point or maximum lying on the greater half axis, the ellipses being blended into each other at the common vertex point.

In accordance with a further feature of the invention, the first and second ellipses have smaller or minor half axes of equal length i.e. the first and second ellipse segments are a segment of a single ellipse.

In accordance with an added feature of the invention, the larger and smaller half axes of the first and second ellipses all are of equal length. In that case the first and second ellipse segments become a single circle segment.

In accordance with an additional feature of the invention, the second order parabola segment has a vertex point and the first circle segment in the vertex point continues in the parabola segment, i.e. the first circular section adjoins the parabola section at maximum or minimum.

Because this transition is effected with a continuous curvature, this means, that the radius of the first clrcle segment corresponds to the radius of the vertex circle of the second order parabola.

In accordance with a concomitant feature of the invention, there is provided a blade base and a blade point, the profile contour being formed of second order curves having parameters varying between the base and the point.

This permits a quick and uncomplicated creation of cylindrical and twisted turbo machine blades, the mass along the blade of which can be constant or variable. The mass change can be linear, exponential corresponding to the physical tension strength, or it may vary according to any predetermined rule.

Other features which are considered as characteristic for the invention are set forth in the appended claims.

Although the invention is illustrated and described herein as embodied in a turbo-machine blade, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
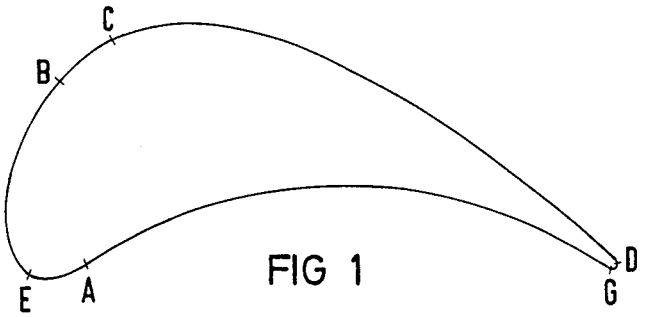
FIG. 1 is a diagrammatic view of a profile contour formed by two ellipse segments, a parabola segment and three circle segments.

Referring now to the figures of the drawing and first particularly to FIG. 1 thereof, there is seen the profile of a turbo-machine blade including six profile segments which gradually blend into each other. Beginning in the transition region between the pressure side and the forward or leading edge, the profile contour between the points A and E is formed by a first ellipse segment. A second ellipse segment EB borders on the first ellipse segment AE and continues into the region of the suction side. The further path of the profile contour at the suction side is formed by a first circle segment BC and by a parabola segment CD of a second order parabola adjacent to it. The rear or trailing edge is formed by a second circle segment DG, which borders on the parabola segment CD.

In the pressure side region, a third circle segment GA follows the second circle segment DG, whereby this third circle segment blends into the first ellipse segment AE toward the front edge.

Figure 2:
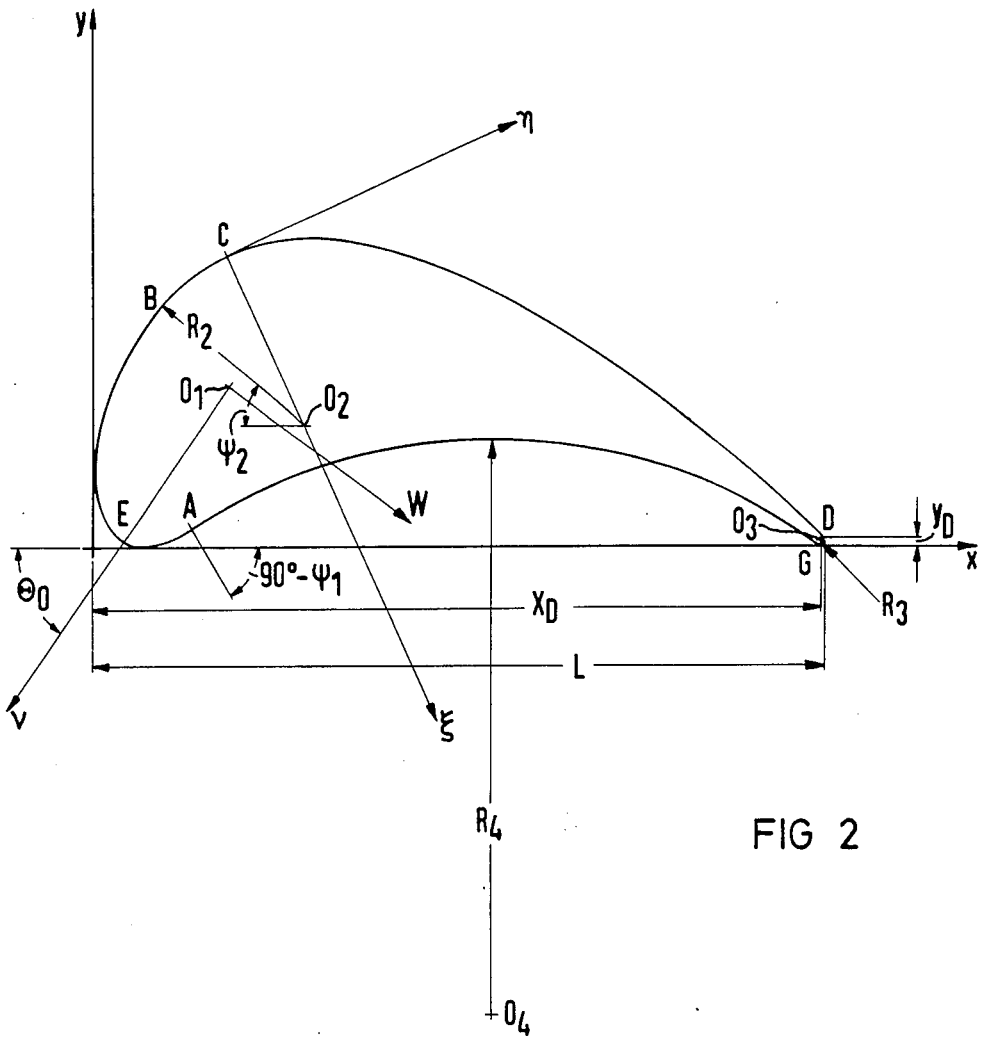
FIG. 2 is a view of the profile contour shown in FIG. 1 with reference axes and the parameters of the individual curve segments.

For further explanation of the profile contour shown in FIG. 1, reference is made to FIG. 2. A Cartesian x-y coordinate system is used as a reference system with the abscissa axis x and the ordinate axis y. The abscissa x axis in the rear edge region and in the region of the front edge is tangent to the profile contour, and the ordinate y axis is tangent to the profile contour in the region of the front edge thereof.

The first ellipse segment AE is locally related to a coordinate system V-W, having a center designated with reference character $0_1$, and an abscissa V axis forming the angle $\theta_o$ with the abscissa x axis of the main system. The first ellipse segment AE can then be represented by the center-point equation $$S = \frac{1}{k_2} \sqrt{V_o^2 - V^2}$$

where $V_o$ designates the greater half-axis, $W_{o2}$ the smaller half axis, and $$k_2 = \frac{V_o}{W_{o2}}$$

designates the half axis ratio.

The second ellipse segment EB is also locally related to the coordinate system V-W, and can be represented by the central point equation $$W = \frac{1}{k_1} \sqrt{V_o^2 - V^2}$$

whereby $V_o$ represents the greater half axis, $W_{01}$ the smaller half axis, and $$k_2 = \frac{V_O}{W_{o1}}$$

designates the half axis ratio.

Since the greater half axis $V_o$ is the same for both ellipses, the point E forms a common vertex point for the first ellipse segment AE and the second ellipse segment EB.

The first circle segment BC is defined by a circle having a center designated by reference character $0_2$, and a radius $R_2$.

The parabola segment CD is locally related to a coordinate system $\xi-\eta$, having an origin or zero-point which lies at point C, and an abscissa-axis $\xi$ that passes through the center $0_2$ of the circle segment BC. The parabola segment CD can be represented by the vertex equation $$\eta^2 = 2R_2\xi$$

From this vertex equation it can be seen that the radius of the first circle segment BC is the same as the radius of the vertex or apex circle of the parabola. Therefore, the first circle segment BC can also be described by the equation $$\eta^2 = \xi(2R_{2\,2} - \xi)$$

The second circle segment DG is defined by a circle having a center designated by reference character $0_3$, and a radius $R_3$. This circle is related to the coordinate system x - y, and is tangent thereto at the abscissa x axis.

The third circle segment GA is defined by a circle having a center designated by reference character $0_4$, and a radius $R_4$. This circle is also related to the coordinate system x - y.

Furthermore, in FIG. 2 the length of the profile contour is designated with reference character L. The distance from the origin to point D along the x axis is $x_D$ and along the y axis is $y_D$. The angle between the normal at point A and the ordinate y axis is designated $\psi_1$, and the angle between the normal at point B and the abscissa x axis is designated $\psi_2$.

Thus, the form of the profile contour is defined by the following ten parameters:

1. The profile length L,
2. The magnitude of the half axis ratio $k_1$,
3. The magnitude of the half axis ratio $k_2$,
4. The length of the half axis $V_o$,
5. The magnitude of angle $\theta_o$.
6. The length of the vertex circle radius $R_2$ of the parabola,
7. The magnitude of angle $\psi_1$,
8. The magnitude of angle $\psi_2$,
9. The length of the coordinate $x_D$ point D, and
10 The length of the coordinate $Y_D$ of the point D.

By varying the preceding parameters, a suitable profile contour can be found for the construction of a turbo machine blade, which fulfills the flow-dynamical and mechanical requirements. In FIGS. 3 to 6, examples of typical profile contours are shown. In order to simplify the drawing, the respective coordinate systems and the individual parameters are not shown in these figures. However, the coordinate systems and parameters described in FIG. 2 also apply in the same way for the profile contours shown in FIGS. 3 to 6.

Figure 3:
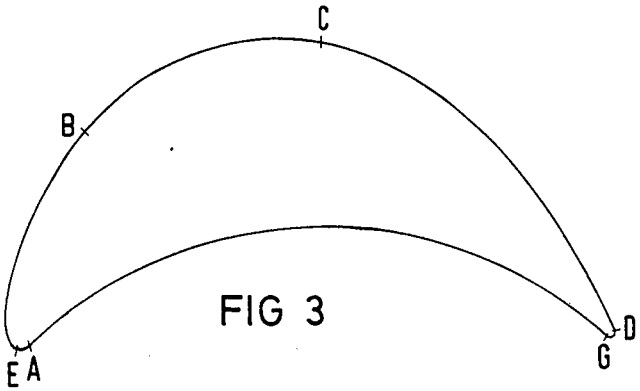
FIG. 3 is a view similar to FIG. 1 of a strongly curved profile contour, also including two ellipse segments, a parabola segment and three circle segments.

FIG. 3 shows a strongly curved profile contour. The decisive features of the strong curvature are the relative large angle $\theta_o$, and a relatively great length of the vertex radius $R_2$ of the parabola.

Figure 4:
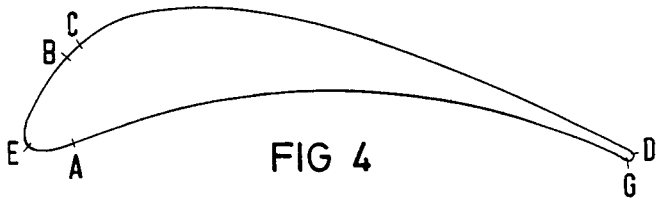
FIG. 4 is another view similar to FIG. 1 of a profile contour formed by one ellipse segment, one parabola segment, and three circle segments.

FIG. 4 shows a profile contour in which the half axis ratios $k_1$ and $k_2$ have the same magnitude. Therefore, the ellipse segments AE and EB belong to the same ellipse, i.e. the profile contour in this region is formed by a single ellipse segment AB.

Figure 5:
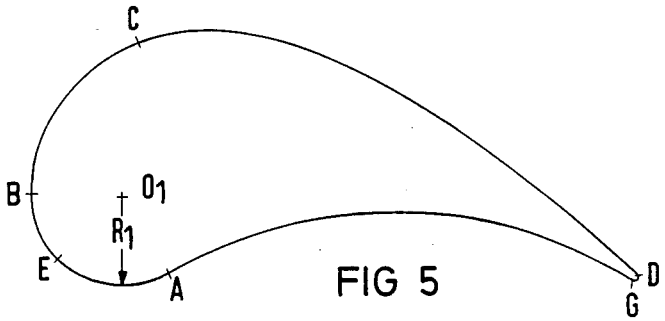
FIG. 5 is a further view similar to FIG. 1 of a profile contour formed by one parabola segment, and four circle segments.

FIG. 5 shows a special case, wherein the half axis ratios $k_1$ and $k_2$ have the same magnitude, and have the value one. In this case the ellipse becomes a circle with the radius $R_1 = V_0$, and the profile contour between the points A and B is formed by a circle segment AB.

Figure 6:
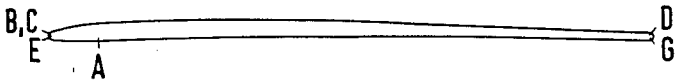
FIG. 6 is a final view similar to FIG. 1 of an extremely flat profile contour, which is formed by one ellipse segment, one parabola segment and two circle-segments.

Finally, FIG. 6 shows an extremely flat profile contour, which, for example, is suited for the outer end region of a turbo machine blade. A very small angle $\theta_o$ and a short length of the vertex radius $R_2$ of the parabola are responsible for the small curvature. The two ellipse segments AE and EB are formed by a single ellipse segment, because the half axis ratios have the same magnitude. The arc length of the first circle segment BC at the illustrated profile form is so small that the points B and C practically fall together.

In general, during the construction of a profile contour, the following influences of the parameters on the profile shape are to be considered:

(a) Influence of the half axis ratios $k_1$ and $k_2$.

Case 1:

$$k_1 = k_2 > 1$$

The ellipse segments AE and EB lie symmetrically to the abscissa V axis.

Generally it can be said that the greater that $k_1$ and $k_2$ are, the nearer the eclipse segments AE and EB move to the abscissa $V_o$ axis.

Case 2:

$$1 < k_1 \neq k_2 > 1$$

The ellipse segment with the smaller k-value lies further away from the abscissa V axis than the ellipse segment with the greater k-value.

Case 3: $k_1 = k_2 = 1$

In this case the ellipse becomes a circle with the radius $$R_1 = V_o$$

(b) Influence of the length of the half axis $V_o$.

Together with the half axis ratios $k_1$ and $k_2$, the magnitude of $V_o$ directly influences the form of the ellipse segments AE and EB.

(c) Influence of the angle $\theta_o$.

The greater the angle $\theta_o$, the more curved becomes the profile contour, and vice versa.

(d) Influence of the radius $R_2$.

The parabola segment CD becomes flatter as the radius $R_2$ becomes smaller.

(e) Influence of the angle $\psi_1$.

As the angle $\psi_1$ increases, the ellipse segment AE gets longer, and the radius $R_4$ gets shorter.

(f) Influence of the angle $\psi_2$.

As the angle $\psi_2$ increases, the ellipse segment EB gets longer.

(g) Influence of the coordinates of point D.

An increase of the ordinate value $Y_D$ causes an elongation of the second circle segment DG.

The abscissa value $x_D$ influences the position of the curvature maximum in the region of the suction side.

By using the hereinafore-described parameters, it becomes possible to construct profiles with the required strength properties and aerodynamic forms. After the aerodynamic calculations are completed, and based on the results obtained, an aerodynamic optimum can be achieved by minor changes of the respective parameters, without reducing the required strength properties. Suitably programmed computers can be used for producing the profile contour, the strength calculations, the aerodynamic calculations, and the aerodynamic optimization.

There is claimed:

1. Turbo-machine blade with a profile contour having a convex leading edge region, a convex suction side region, a convex trailing edge region and a concavely curved pressure side region, comprising profile segments being blended into each other forming the profile contour and following each other in a continuous curve, said profile segments including:

(a) a first ellipse segment and a second ellipse segment adjacent to said first ellipse segment in the leading edge region, (b) a first circle segment adjacent to said second ellipse segment and a second order parabola segment adjacent to said first circle segment in the suction side region, (c) a second circle segment adjacent to said parabola segment in the trailing edge region, and (d) a third circle segment adjacent to said second circle segment and said first ellipse segment in the pressure side region.

2. Turbo-machine blade according to claim 1, wherein said first ellipse segment and said second ellipse segment are formed of ellipses having a common greater half axis and a common vertex point lying on said greater half axis, said ellipses being blended into each other at said common vertex point.

3. Turbo-machine blade according to claim 2, wherein said first and second ellipses have smaller half axes of equal length.

4. Turbo-machine blade according to claim 3, wherein said larger and smaller half axes of said first and second ellipses all are of equal length.

5. Turbo-machine blade acoording to claim 1, wherein said second order parabola segment has a vertex point and said first circle segment in said vertex point continues in said parabola segment.

6. Turbo-machine blade according to claim 1, including a blade base and a blade point, the profile contour being formed of second order curves having parameters varying between said base and said point.

* * * * *